US005168807A

United States Patent [19]

Elia et al.

[11] Patent Number: 5,168,807

[45] Date of Patent: Dec. 8, 1992

[54] PRINTING APPARATUS AND METHOD

[75] Inventors: Frederick J. Elia, Sarasota, Fla.; Giacinto R. Mazzenga, Lake Como, Pa.

[73] Assignee: Como Technologies, Inc., Sarasota, Fla.

[21] Appl. No.: 709,780

[22] Filed: Jun. 3, 1991

Related U.S. Application Data

[63] Continuation-in-part of Ser. No. 605,571, Oct. 30, 1990.

[51] Int. Cl.[5] ..... B41F 31/08; B41F 31/06

[52] U.S. Cl. ..... 101/366; 101/483

[58] Field of Search ..... 101/366, 365, 350, 363, 101/207-210, DIG. 45, DIG. 47, 483; 417/286, 426, 62, 2

[56] References Cited

U.S. PATENT DOCUMENTS

| | | | |
|---|---|---|---|
| 3,065,693 | 11/1962 | Neal et al. | 101/366 |
| 3,288,061 | 11/1966 | Doyle | 101/366 |
| 4,461,209 | 7/1984 | Washchynsky | 101/366 |
| 4,649,502 | 3/1987 | Keller et al. | 101/365 |
| 4,792,292 | 12/1988 | Gaenzle | 417/440 |
| 5,018,444 | 5/1991 | Schumacher et al. | 101/365 |
| 5,027,706 | 7/1991 | Niemiro et al. | 101/366 |

*Primary Examiner*—J. Reed Fisher

*Attorney, Agent, or Firm*—Tarolli, Sundheim & Covell

[57] ABSTRACT

An auxiliary apparatus is provided to supply ink to a printing press upon failure of a main ink pump assembly in the printing press. The auxiliary apparatus includes a portable auxiliary ink pump assembly which is maintained separate from the printing press during normal operation of the main ink pump assembly. Upon failure of the main ink pump assembly to properly supply ink, the auxiliary ink pump assembly is moved to a location adjacent to the failed main ink pump assembly. The failed main ink pump assembly is disconnected from the ink rail of the printing press. The auxiliary ink pump assembly is connected in fluid communication with the ink rail. A motor connected with the auxiliary ink pump assembly then drives the auxiliary ink pump assembly to supply ink to the ink rail. The speed of operation of the motor and auxiliary ink pump assembly is varied as a function of variations in the operating speed of the printing press and the density with which ink is printed on sheet material moving through the press.

10 Claims, 3 Drawing Sheets

PRINTING APPARATUS AND METHOD

RELATED APPLICATION

This application is a continuation-in-part of U.S. patent application Ser. No. 605,571, filed Oct. 30, 1990 by Giancinto R. Mazzenga and Frederick J. Elia and entitled "Printing Press Ink Supply System".

BACKGROUND OF THE INVENTION

The present invention relates to a printing apparatus and method and, more specifically, to the use of an auxiliary ink pump to supply ink to a printing press in the event of failure of a main ink pump.

During operation of a printing press, an ink pump may fail to supply ink to an ink rail of the printing press. When this occurs, the printing press may be shut down and the pump assembly repaired. Once the pump assembly has been repaired, the printing press resumes production. Of course, having a printing press out of production for the time required to repair an ink pump is detrimental to efficient commercial operation of a printing press.

SUMMARY OF THE INVENTION

The present invention provides a new and improved apparatus and method for supplying ink to a printing press upon failure of a main ink pump. The apparatus includes a portable auxiliary ink pump which is maintained separate from the printing press during normal operation of the main ink pump. Upon failure of the main ink pump to supply ink to the printing press, the auxiliary ink pump is moved from a remote location spaced from the printing press to an operating location adjacent to the failed main ink pump. A conduit is provided to connect auxiliary ink pump in fluid communication with the printing press. A motor connected with the auxiliary ink pump is then operated to drive the auxiliary ink pump to supply ink to the printing press through the conduit.

Accordingly, it is an object of this invention to provide a new and improved apparatus and method for use in supplying ink to a printing press upon failure of a main ink pump and wherein a portable auxiliary ink pump is connected with the printing press to supply ink upon failure of the main ink pump.

BRIEF DESCRIPTION OF THE DRAWINGS

The foregoing and other features of the present invention will become more apparent upon a consideration of the following description taken in connection with the accompanying drawings, wherein.

DESCRIPTION OF A SPECIFIC PREFERRED EMBODIMENT OF THE INVENTION

Printing Press

Figure 1:
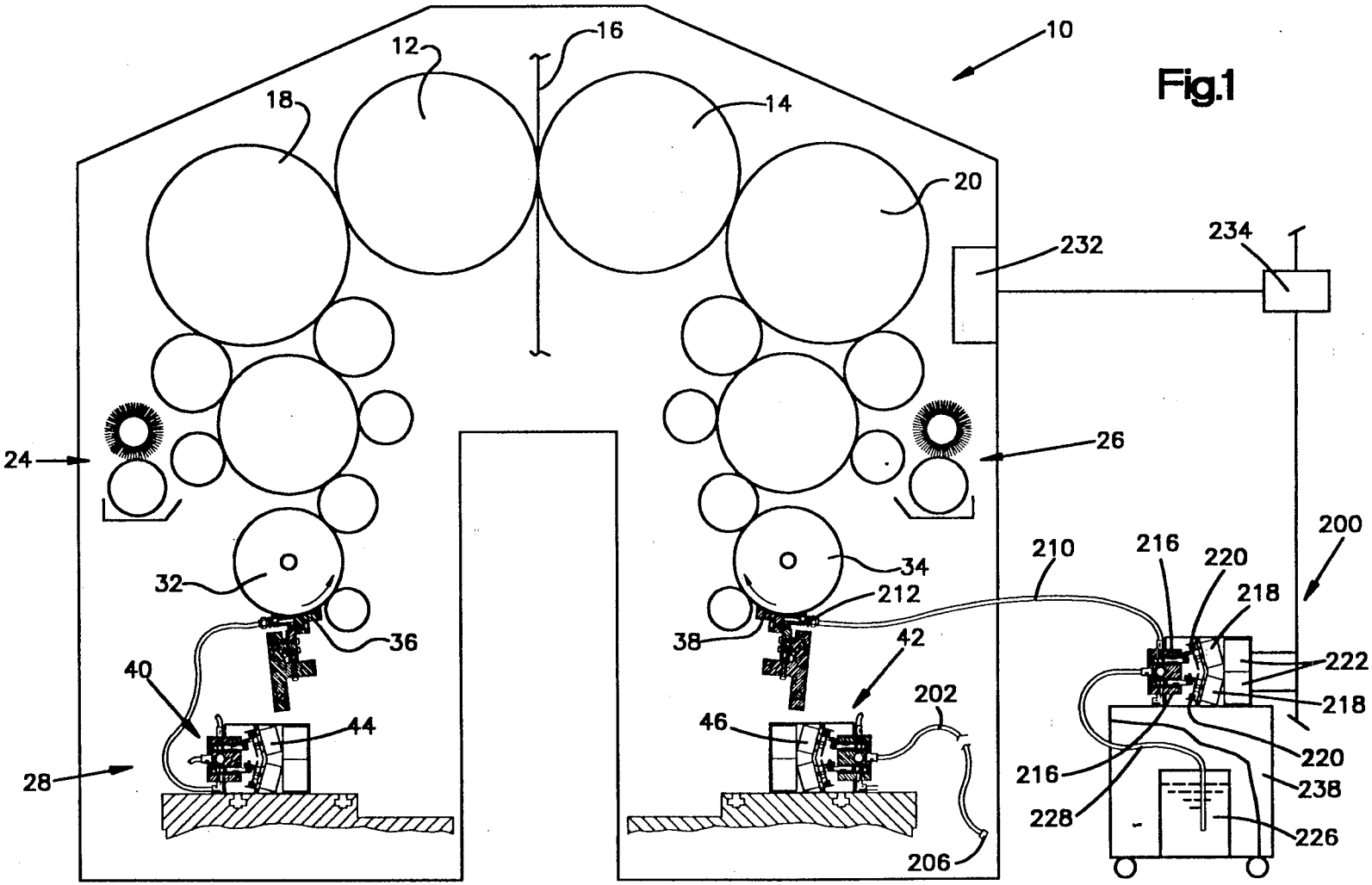
FIG. 1 is a schematic illustration depicting the relationship between a printing press and auxiliary apparatus for supplying ink to the printing press upon failure of a main ink pump in the printing press.

An offset lithographic printing press 10 of a generally known construction is illustrated schematically in FIG. 1. The printing press 10 includes a pair of blanket rolls 12 and 14 which print on opposite sides of a sheet material web 16 during operation of the printing press. An ink image is transferred to the blanket rolls 12 and 14 by a pair of plate rolls 18 and 20.

To provide for the formation of an ink image on the plate rolls 18 and 20, water or other dampening solution is supplied to the plate rolls by dampener assemblies 24 and 26. Ink is applied to the surface of the plate rolls 18 and 20 by identical main inker assemblies 28 and 30. Thus, during operation of the printing press, ink is applied to ink transfer rolls 32 and 34 by ink rails 36 and 38. The ink rails 36 and 38 are supplied with ink from main pump assemblies 40 and 42 disposed at pumping stations in the printing press (10). The main pump assemblies 40 and 42 are driven by main motors 44 and 46 disposed at the pumping stations in the printing press (10). It should be understood that each ink rail 36 or 38 is supplied with ink by a plurality, for example eight or ten, identical main pump assemblies 40 or 42 driven by identical main motors 44 or 46.

Although it is preferred to use main inker assemblies 28 and 30 constructed in accordance with the present invention in an offset lithographic printing press, it should be understood that the main inker assemblies 28 and 30 could be associated with a different type of printing press if desired. The press 10 may print on the web 16 or may be of the sheet feed type. In addition, a different type of inker assembly could be used. Thus, rather than using the ink rail 36 to apply ink to the roll 32, ink could be sprayed onto the roll or directly onto the plate roll if desired. Thus, it should be understood that the invention is not to be considered as being limited to use in any particular type of printing press.

Inker Assembly

The inker assembly 28 includes a variable speed main electric motor 44 (FIG. 2) disposed at a pumping station in the printing press (10). The main motor 44 has an output shaft 50 connected with a main drive assembly 52. The main drive assembly 52 is in turn connected with a cylindrical piston 54 of the main pump assembly 40. The main pump assembly (40) is disposed at a pumping station in the printing press (10). During operation of the main motor 44, the main drive assembly 52 reciprocates the piston 54 to operate the main pump assembly 40. Although only a pair of main electric motors 44, drive assemblies 52 and pump assemblies 40 have been shown in FIG. 2, any desired number could be used. For example, four or five pairs of main electric motors 44, drive assemblies 52 and pump assemblies 40 could be used to supply ink to the ink rail 36.

The main electric motor 44 is of the well known stepper type. Thus, during operation of the main motor 44, the output shaft 50 is moved through equal length increments or steps. These steps occur so fast as to appear to be a continuous rotational motion.

Rotation of the motor output shaft 50 operates the main drive assembly 52 to reciprocate the piston 54. Thus, the motor output shaft 50 is fixedly connected to a crank arm 58 (FIG. 2) which forms an input member for the drive assembly 52. The crank arm 58 is rotated about the central axis of the motor output shaft 50 during operation of the motor 44.

The drive assembly 52 includes a cylindrical output member or drive pin 62 which extends through a spherical ball 64 of a ball and socket type universal joint 66. The ball and socket universal joint 66 is mounted on the crank arm 58 and rotates with the crank arm. The ball and socket universal joint 66 includes a circular socket 68 which is fixedly connected with the crank arm 58. The ball 64 is rotatably held by the socket 68 and is free to rotate relative to the crank arm 58 during rotation of the crank arm.

The drive pin 62 extends through a cylindrical opening in the ball 64. During rotation of the crank arm 58, the drive pin 62 slides axially in the opening in the ball 64. The opposite end of the drive pin 62 is fixedly secured to the outer end of the piston 54. During rotation of the crank arm 58 by the motor output shaft 50, the crank arm rotates from the position shown in solid lines in FIG. 2 to the position shown in dashed lines in FIG. 2.

The general construction of the main drive assembly 52 is known and is generally similar to the construction of drive assemblies disclosed in U.S. Pat. Nos. 3,168,872 and 3,366,051. It is contemplated that other known types of drive assemblies could be utilized if desired. For example, a wobble or cam plate similar to the one disclosed in U.S. Pat. No. 4,461,209 could be used if desired.

The main pump assembly 40 includes a cylinder or housing 76 which is fixedly connected with a stationary base 78. The cylindrical piston 54 is slidably received in the cylinder 76 and cooperates with the cylinder to define a variable volume pump chamber 82.

The main pump assembly 40 operates through one complete operating cycle for each revolution of the motor output shaft 50 and crank arm 58. Rotation of the motor output shaft 50 through one-half of a revolution rotates the crank arm 58 from the position shown in solid lines in FIG. 2 to the position shown in dashed lines. As the crank arm 58 rotates from the position shown in solid lines to the position shown in dashed lines, the piston 54 moves leftwardly (as viewed in FIG. 2) along a linear path through a discharge stroke. When the piston 54 is in the extended position shown in solid lines in FIG. 2, at the beginning of a discharge stroke, the cylindrical pump chamber 82 has a maximum volume. When the crank arm 58 is rotated to the retracted position shown in dashed lines in FIG. 2, the piston 54 will have moved through a linear discharge stroke and the pump chamber 82 will have a minimum volume.

Figure 2:
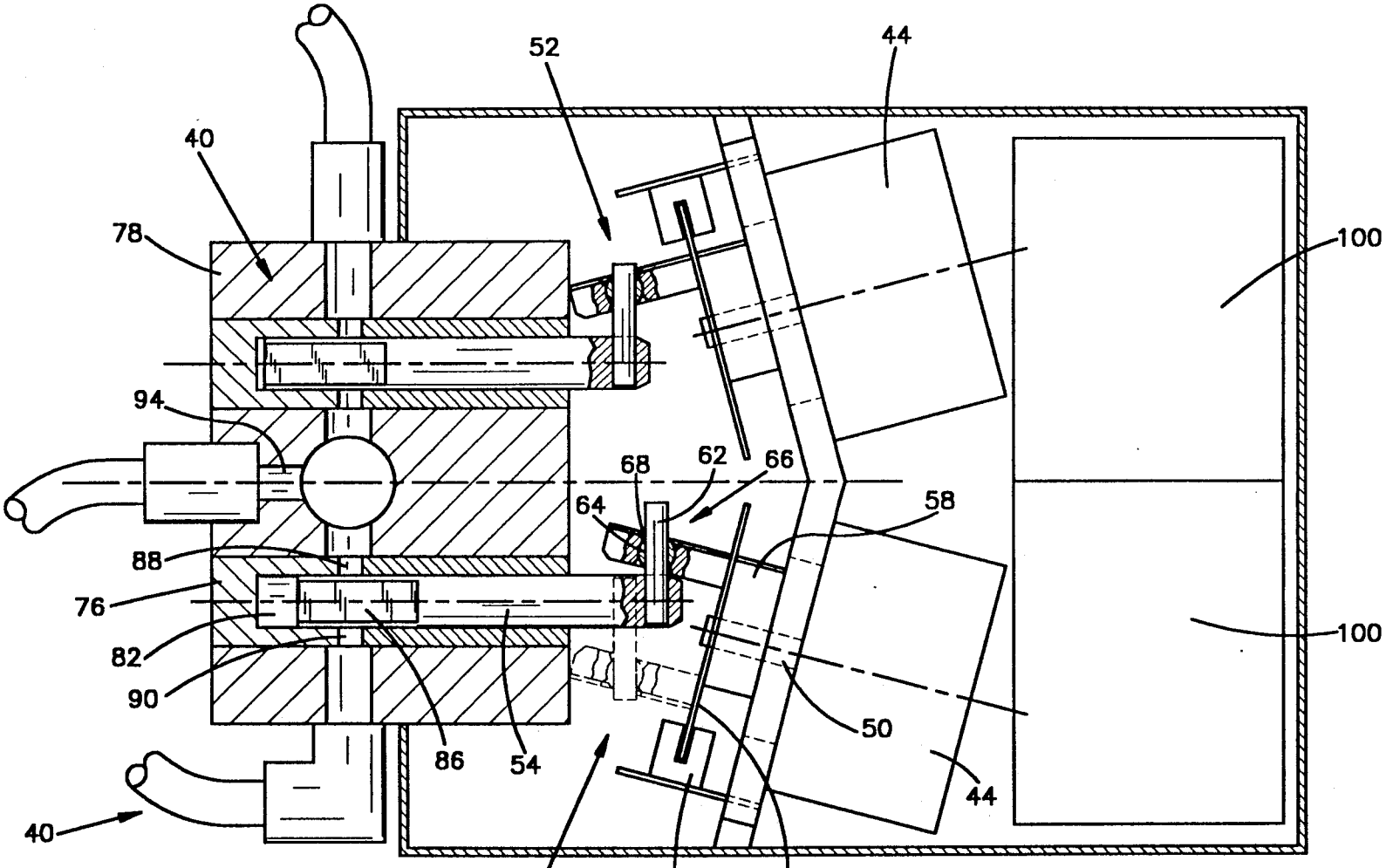
FIG. 2 is an enlarged, partially broken away illustration depicting the relationship between a main ink pump assembly, main motor, and main drive assembly in the printing press of FIG. 1.

Continued operation of the motor 44 rotates the crank arm 58 through one-half of a revolution from the position shown in dashed lines in FIG. 2 to the position shown in solid lines in FIG. 2. As this occurs, the piston 54 moves through a linear intake stroke and the size of the pump chamber increases. Thus, the volume of the pump chamber increases from a minimum volume to a maximum volume as the crank arm 58 rotates from the retracted position shown in dashed lines in FIG. 2 to the extended position shown in solid lines in FIG. 2.

As the crank arm 58 reciprocates the piston 54 along a linear path, the crank arm also rotates the cylindrical piston about its central axis. As the piston 54 is rotated, a valve surface or flat 86 on the piston rotates relative to an intake port 88 and a discharge port 90 to control fluid flow into and out of the pump chamber 82. The valve surface 86 intersects and extends parallel to a longitudinal central axis of the cylindrical piston 54.

During the intake portion of the pump operating cycle, the pump chamber 82 increases in volume. Thus, during the intake portion of the pump operating cycle, the piston 54 moves from the retracted position shown in dashed lines in FIG. 2 to the extended position shown in solid lines in FIG. 2. As this occurs, an arcuate outer side surface of the cylindrical piston 54 blocks the outlet port 90. At this time, the flat or valving surface 86 cooperates with the inlet port 88 to enable ink to flow from an inlet passage 94 through the inlet port 88 into the cylindrical pump chamber 82.

Figure 3:
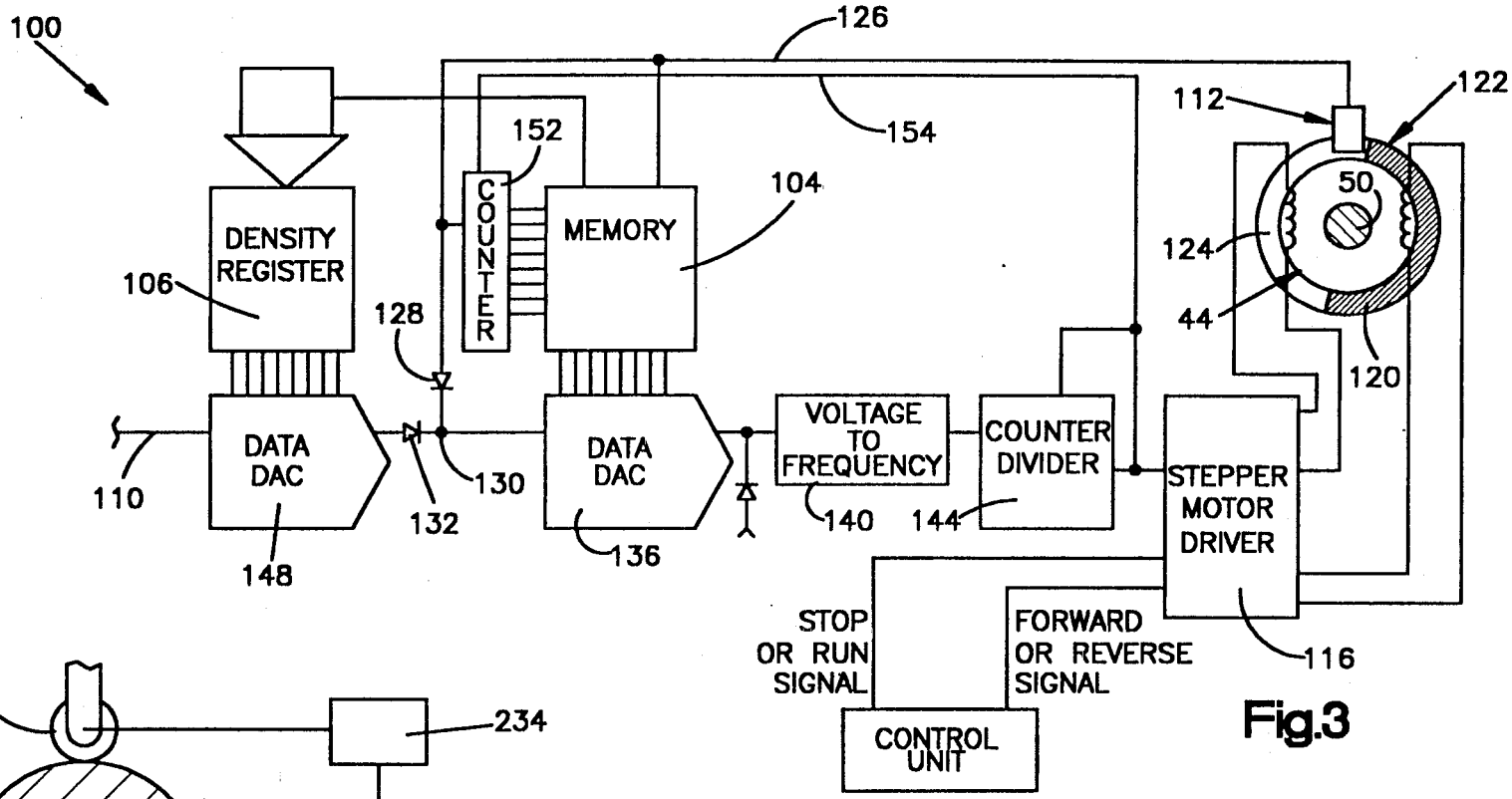
FIG. 3 is a schematic illustration of a control system used to control the operation of the main motor of FIG. 2.

During the discharge portion of the pump operating cycle, the piston 54 moves from the extended position shown in solid lines in FIG. 3 to the retracted position shown in dashed lines in FIG. 3 with a resulting decrease in the volume of the pump chamber 82. As this occurs, the arcuate side surface of the piston 54 blocks the inlet port 88. The flat valve surface 86 on the piston cooperates with the outlet port 90 to allow ink to flow from the contracting pump chamber 82 through the outlet port.

The pump assembly 40 has a construction and mode of operation similar to the pump assemblies disclosed in U.S. Pat. Nos. 3,168,872 and 3,366,051. However, it should be understood that other known types of pump assemblies could be utilized in place of the specific pump assembly 40 illustrated in FIG. 3. If desired, a gear unit could be connected between the motor 44 and drive assembly 52 so that each revolution of the motor shaft 50 would not result in operation of the pump assembly 40 through a complete operating cycle. It should be understood that although only a pair of motors 44, drive assemblies 52 and pump assemblies 40 have been shown in FIGS. 2 and 3, additional motors, drive assemblies and pump assemblies are provided.

The construction of the drive assembly 52 is such that equal increments of rotation of the motor output shaft 50 and crank arm 58 do not result in equal increments of linear movement of the piston 54. As a result of the conversion of rotational motion of the motor output shaft 50 to linear motion of the piston 54, the displacement or movement of the piston 54 varies as a generally sinusoidal function of rotation of the crank arm 58. Thus, if the motor output shaft 50 and crank arm 58 are rotated at a constant speed, the speed of movement of the piston 54 will vary during the intake and discharge strokes. This results in a relatively large displacement of the piston 54 relative to the cylinder 76 occurring for each increment of rotation of the motor output shaft 50 and crank arm 58 when the piston 54 is near the central portion of either an intake or discharge stroke. When the piston 54 is near the beginning or end of an intake or discharge stroke, there is a relatively small displacement of the piston relative to the cylinder 76 for each increment of rotation of the motor output shaft 50 and crank arm 58.

The rate of flow of ink from the pump chamber 84 is a direct function of movement of the piston 54. In order to obtain a constant ink flow rate from the pump assembly 40, it is necessary to maintain the speed of movement of the piston 54 constant during a discharge stroke of the piston. Thus, to enable the pump assembly 40 to discharge ink through the outlet 90 at a constant flow rate, the piston 54 must move at a constant speed from the extended position shown in solid lines in FIG. 2 to the retracted position shown in dashed lines in FIG. 2.

The drive assembly 52 cooperates with the piston 54 in such a manner that if the motor output shaft 50 is rotated at a constant speed, the speed of movement of the piston 54 varies. Thus, if the speed of operation of the motor 44 is maintained constant, the flow rate of ink from the pump assembly 40 will vary. During constant speed rotation of the motor output shaft 50, there will be a relatively small or low flow rate of ink from the pump assembly 40 when the piston 54 is adjacent to either its beginning or end of stroke positions. There will be a relatively large flow rate of ink from the pump assembly 40 when the piston 54 is adjacent to the central portion of its stroke.

This uneven flow of ink from the pump assembly 40 during rotation of the motor output shaft 50 at a constant speed results from the conversion of the circular rotational motion of the crank arm 58 to linear motion of the piston 54. Of course, a nonuniform flow rate of ink from the pump assembly 40 during a discharge stroke of the piston 54 is detrimental to the quality of print obtained with the printing press.

During an intake stroke of the pump assembly 40, the flow of ink from the pump assembly is stopped. However, during the intake stroke of the pump assembly, the printing press is still printing on the web 16 (FIG. 1). Therefore, the demand for ink continues during the intake stroke of the pump assembly 40. If the motor output shaft 50 is rotated at a constant speed, the duration of an intake stroke of the pump assembly 40 is equal to the duration of the discharge stroke of the pump assembly. Therefore, during one-half of the time the pump assembly 40 is being operated, there would be no ink flow from the pump assembly.

Although there is a constant demand for ink by the printing press 10 during operation of the printing press, the demand for ink varies as a function of operating speed of the printing press. Thus, when the printing press 10 is operating at a relatively slow speed, the amount of ink applied to the web 16 for each increment of time is less than the amount of ink applied to the web 16 for each increment of time when the printing press is operating at a high speed. Therefore, the greater the operating speed of the printing press, the greater is the need for ink to be discharged from the pump assembly 40.

Motor Control System

Although one specific main pump assembly 40 and main drive assembly 52 have been illustrated in association with a motor 44 in FIG. 2, other known pump assemblies and drive assemblies could be used if desired. In fact, it is contemplated that rather than being driven by individual motors 44, a plurality of ink pumps of a known construction could be driven by a single motor or by the printing press drive; in a known manner. Thus, a single motor could be used to drive a plurality of ink pumps as is disclosed in U.S. Pat. No. 3,608,486. If desired, the ink pumps could be driven by a printing press drive, as is disclosed in U.S. Pat. Nos. 3,366,051; 2,866,411 and 2,695,561.

During operation of the pump assembly 40, the speed of operation of the motor 44 is varied to minimize the duration of the intake portion of the pump operating cycle and to maximize the duration of the discharge portion of the pump operating cycle. Thus, in one specific embodiment, the piston 54 was moved through an intake stroke, that is, from the position shown in dashed lines in FIG. 2 to the position shown in solid lines in FIG. 2, in about 0.125 seconds. Depending upon press operating speed and the demand for ink, the operating speed of the pump during the discharge stroke could be such as to have a discharge stroke of a duration which is between 5 and 100 times the duration of the intake stroke. Thus, depending upon the demand for ink, the motor 44 is operated to move the piston 54 from the position shown in solid lines in FIG. 2 to the position shown in dashed lines in FIG. 2 in 0.625 to 12.50 seconds while the intake stroke is completed in only 0.125 seconds.

By having the duration of the discharge stroke of the pump assembly 40 be between 5 and 100 times the duration of the intake stroke, a flow of ink is maintained from the pump assembly 40 during the large majority of each operating cycle of the pump assembly. Of course, the duration of the discharge portion of the pump operating cycle will vary as a function of the amount of ink required to print specific text or images on the web 16. The duration of the discharge portion of the pump operating cycle will also vary as a function of operating speed of the printing press 10. Thus, the slower the operating speed of the printing press, the longer is the discharge portion of the pump operating cycle.

Since the duration of the intake portion of the pump operating cycle is so much shorter than the duration of the discharge portion of the pump operating cycle, the flow of ink from the pump assembly 40 appears to be relatively uniform. This is because a flow of ink from the pump assembly 40 is established and maintained during the relatively long discharge portion of the pump operating cycle. A brief interruption in ink flow from the pump assembly 40 for the intake portion of the pump operating cycle causes only what appears to be a minor fluctuation in the pressure of the ink flow. Of course, this tends to promote a uniform supply of ink at the rail 36 (FIG. 2) and to enhance the quality of the material printed on the web 16.

Although the intake portion of the pump operating cycle is of a relatively short duration, the velocity of the piston 54 varies greatly during the intake portion of the pump operating cycle. At the beginning and end of an intake stroke, the speed of movement of the piston 54 is relatively slow. However, during the relatively large central portion of the intake stroke, the piston 54 is moving very fast. Thus, the motor 44 is operated at a constant, high speed, during the intake stroke. In converting the constant speed rotational motion of the motor output shaft 50 to linear motion of the piston 54, the drive assembly 52 causes the speed of the piston and the rate of flow of ink into the pump assembly 40 to vary through a large range.

During the relatively long duration of the discharge portion of the pump operating cycle, the speed of operation of the motor 44 is varied to maintain a constant rate of flow of ink from the pump assembly 40. Once the pump operating cycle has shifted from the intake portion to the discharge portion, the piston 54 moves through equal increments of distance relative to the cylinder 76 during equal increments of time. Thus, the speed of movement of the piston 54 remains constant during the discharge portion of the pump operating cycle.

The illustrated main motor 44 is of the well known stepper type in which the motor is energized to move through incremental distances or steps. The speed at which each step of the motor occurs remains constant.

However, the frequency of the steps is varied to vary the rate of operation of the motor.

To obtain a high rate of ink flow into the pump assembly 40, the stepper motor 44 is operated to take steps at a very high frequency. To maintain a relatively low rate of flow of ink from the pump assembly 40, the stepper motor 44 is operated to take steps at a relatively low frequency. By operating the motor 44 to take steps at a high frequency during the intake portion of the operating cycle of the pump assembly 40 and by operating the motor to take steps at a low frequency during the discharge portion of the pump operating cycle, the intake portion of the pump operating cycle is of very short duration compared to the duration of the discharge portion of the pump operating cycle. Of course, other known types of variable speed motors could be utilized if desired.

The rate of operation of the motor 44 is varied during the discharge portion of the pump operating cycle to maintain a constant flow rate of ink from the pump assembly 40. If the motor 44 is operated at a constant rate during the discharge portion of the pump operating cycle, the drive assembly 52 causes the speed of movement of the piston 54 would vary in a sinusoidal manner. Of course, this would result in variations in the rate of flow of ink from the pump assembly 40.

To maintain a constant rate of flow of ink from the pump assembly 40 during the discharge portion of the pump operating cycle, the rate of operation of the motor 44 is varied to maintain the velocity of the piston 54 constant. Since the piston 54 has a constant velocity, the piston moves through the same incremental distance for each unit of time. Therefore, the volume of ink discharged from the pump chamber 82 remains the same for each unit of time.

During the intake portion of the pump operating cycle, the motor 44 is operated at a constant speed which is as fast as is practically possible. This results in the duration of the intake portion of the pump operating cycle being as short as is practically possible. Since the motor 44 is operated at a relatively high constant speed during the intake portion of a pump operating cycle, the speed of movement of the piston 54 varies sinusoidally during the intake portion of the pump operating cycle. The speed of movement of the piston and the flow of ink into the pump chamber 82 will be a maximum when the piston is moving through a central portion of its operating stroke. The speed of movement of the piston 54 and the rate of flow of ink into the pump chamber 82 will be relatively low when the piston is adjacent to either end of its operating stroke.

During the discharge portion of the pump operating cycle, the speed of operation of the motor is varied. However, the average speed of operation of the motor 44 during the discharge portion of the pump operating cycle is always substantially less than the average speed of operation of the motor 44 during the intake portion of the pump operating cycle. During the discharge portion of the pump operating cycle, the speed of operation of the motor 44 is the greatest when the piston 54 is adjacent to the opposite ends of its discharge stroke and is the least when the piston is adjacent to a central portion of its discharge stroke. Although the speed of operation of the motor 44 varies, the speed of movement of the piston 54 remains constant during the discharge portion of pump operating cycle.

One specific embodiment of a main motor control system 100 for controlling the speed of operation of the motor 44 is illustrated schematically in FIG. 3. The main motor control system 100 includes a data storage unit or memory 104. The data storage unit 104 stores data corresponding to multipliers by which a nominal speed of operation of the motor 44 must be varied to effect operation of the drive assembly to move the piston 54 at a constant speed during the discharge portion of a pump operating cycle.

During operation of the printing press 10 at a constant speed, ink pump drive motors, corresponding to the motor 44, have previously been driven at a constant nominal speed. This constant nominal speed of motor operation has resulted in the ink pump piston being moved at a variable speed by the drive assembly. The data storage unit 104 contains data or multipliers by which the previous constant nominal speed of operation of the ink pump drive motor is varied during the discharge portion of the pump operating cycle to effect movement of the piston 54 at a constant speed.

A density register 106 (FIG. 3) stores data which varies as a function of the ink density applied to a portion of the web supplied with ink by the pump assembly 40. Thus, the greater the ink density on the printed portion of the page supplied with ink by the pump assembly 40, the greater the speed of operation of the motor 44 to supply the demand for ink by the pump assembly.

Although the operating speed of the motor 44 is varied during the discharge portion of a pump operating cycle to maintain a constant rate of flow of ink from the pump assembly 40, the rate of operation of the motor 44 is also varied as a function of press operating speed. Thus, a printing press speed input or reference signal is received by the motor control system 100 from a tachometer (not shown) driven by the press drive system. The press speed reference signal is conducted over a lead 110 to the motor control system 100.

A detector assembly 112 is provided in association with the pump drive motor 44 to detect the end of a discharge stroke and the beginning of an intake stroke of the pump assembly 40. In addition, the detector assembly 112 detects the end of an intake stroke and the beginning of a discharge stroke of the pump assembly 40.

A stepper motor driver 116 is connected, through suitable circuitry, with the data storage units 104 and 106 and with the press speed input signal conducted over the lead 110. During the intake portion of the pump operating cycle, the stepper motor driver 116 effects operation of the stepper motor 44 at a very high constant speed which is independent of ink density and press operating speed. During the discharge portion of a pump operating cycle, the stepper motor driver 116 effects operation of the motor 44 at a relatively low speed which is varied as a function of the speed multipliers stored in the register 104, a factor for ink density on the printed page as represented by data stored in the register 106, and a printing press speed signal conducted over the lead 110. It is contemplated that the speed of operation of the printing press will probably remain constant, at a selected speed, during most of the time the printing press is operated to print particular material.

Operation

Upon initiation of an intake stroke of the pump assembly 40, a dark or opaque area 120 on a disk 122 connected with the motor output shaft 50 moves away from the sensor 112 and a light or transparent area 124 on the disk moves to the sensor assembly 112. The dark and light areas 120 and 124 both extend for one-half of the circumference of the disk 122. The crank arm 58 (FIG. 3) extends through an opening (not shown) in the disk 122. Both the crank arm 58 and disk 122 rotate together with the motor output shaft 50.

When the light or transparent area 124 on the disk 122 moves to the sensor head 124, light from an LED is transmitted through the disk to a photodiode. A relatively high voltage signal is then transmitted over a lead 126 to indicate the initiation of the intake portion of the pump operating cycle. Many different types of sensors 112 could be used to detect the beginning and the end of the intake and discharge portions of the pump operating cycle. However, in one specific embodiment, the sensor 112 was obtained from Texas Instruments of Dallas, Texas under the designation of a TIL 147A Optoelectronic Assembly. Of course, other known types of sensors could be used if desired.

The high voltage intake signal on the lead 126 is transmitted through a diode 128 to a junction 130. During the intake portion of an operating cycle of the ink pump assembly 40, the voltage conducted over the lead 126 through the diode 128 is always far greater than the voltage conducted to a second diode 132. Therefore, transmission through the diode 132 is blocked during the intake portion of the pump operating cycle. The high voltage of the signal conducted from the sensors 112 to the junction 130 during the intake portion of a pump operating cycle is of a substantially greater magnitude than the maximum possible voltage signal which will be conducted to the diode 132.

During the intake portion of the pump operating cycle, a relatively high voltage is conducted from the junction 130 to a multiplying digital-to-analog converter 136. The digital-to-analog converter 136 multiplies the input voltage by a constant to still further increase the magnitude of the voltage. In one specific embodiment, the digital-to-analog converter 136 was obtained from Analog Devices of Two Technology Way of Norwood, Massachusetts under the designation of AD 7523 Multiplying D/A Converter. However, other known types of digital-to-analog converters could be used if desired.

The high voltage output from the digital-to-analog converter 136 is conducted to a voltage-to-frequency converter 140. In one specific embodiment, the voltage-to-frequency converter was obtained from Analog Devices of Two Technology Way of Norwood, Massachusetts under the designation of A/D 537 Voltage-to-Frequency Converter. However, it should be understood that other known types of voltage-to-frequency converters could be utilized if desired.

The extremely high frequency output from the voltage-to-frequency converter 140 is conducted to a count divider 144. The count divider 144 divides the relatively high frequency input by a factor, for example 256, to reduce the very high frequency to a range which can be used by the stepper motor driver 116. The output from the count divider 144 is transmitted to the stepper motor driver 116.

The high frequency series of pulses from the count divider 144 effect operation of the stepper motor driver 116 to operate the pump drive motor 44 at a relatively high speed. Thus, the time between pulses conducted to the stepper motor driver during an intake portion of a pump operating cycle is very short and the motor 44 drives the pump 40 as fast as is reasonably possible to minimize the duration of the intake portion of the pump operating cycle. In one specific embodiment, the stepper motor driver was obtained from SGS-Thompson of Phoenix, Arizona under the designation of GS-D200. Of course, other known stepper motor drives could be utilized if desired.

During the intake stroke of the pump assembly 40, the motor 44 operates at a constant and very high rate which is substantially greater than any possible rate at which the motor is operated during a discharge portion of the pump operating cycle. Therefore, the intake portion of the pump operating cycle is of very short duration and the ink quickly flows into the pump chamber 82. Although the rate of operation of the motor 44 remains constant during the intake portion of the pump operating cycle, the speed of movement of the piston 54 varies sinusoidally due to the action of the drive assembly 52. Therefore, although the intake stroke is of very short duration, the flow rate during the intake stroke varies from a minimum flow at the beginning and end of the intake stroke of the piston 54 to a relatively large maximum flow rate as the piston is moving through the central portion of the intake stroke.

The end of the intake portion of the pump operating cycle is detected by the detector assembly 112. During the intake portion of the pump operating cycle, the motor output shaft 50 rotates through 180°. The disk 122 rotates with the motor output shaft 50. At the end of the intake portion of the pump operating cycle, the light or transparent area 124 on the disk 122 moves away from the sensor 112 and the dark or opaque area 120 moves to the sensor. As this occurs, the output voltage conducted over the lead 126 from the sensor 112 immediately decreases to a relatively low value to indicate the beginning of the discharge portion of the pump operating cycle.

The press operating speed voltage signal conducted over the lead 110 from a press driven tachometer to a digital-to-analog converter 148 is multiplied by an ink density factor conducted from a register 106. The ink density factor at the register 106 is set by a press operator to correspond with the density of the ink on the portion of the web supplied with ink by the pump assembly 40. The output from the digital-to-analog converter 148 is conducted to the diode 132. The digital-to-analog converter 148 is of the same construction as the digital-to-analog converter 136.

During the discharge portion of the pump operating cycle, the output voltage from the digital-to-analog converter 148 will be substantially greater than the relatively low voltage conducted from the sensor 112 over the lead 126. Therefore, the relatively high output voltage from the digital-to-analog converter 148 is transmitted through the diode 132 to the junction 130 and blocks the transmission of the relatively low voltage through the diode 128.

A counter 152 is reset by the change in the voltage on the lead 126 from a relatively high voltage to a relatively low voltage indicating the beginning of the discharge portion of the ink pump operating cycle. The second digital-to-analog converter 136 multiplies the reference voltage from the first digital-to-analog converter 148 by data transmitted from the register 104. The data transmitted from the register 104 is a multiplier by which the nominal speed signal voltage from the digital-to-analog converter must be multiplied to obtain the desired constant ink flow rate during the first increment of the discharge portion of the pump operating cycle.

The output from the digital-to-analog converter 136 is changed to a frequency signal by the voltage-to-frequency converter 140. The frequency of this signal is reduced by the count divider 144. The first pulse from the count divider 144 is transmitted over a lead 154 to the counter 152 to step the counter to read data from the next data storage location in the register 104. In addition, the first pulse is transmitted to the stepper motor driver 116 to effect operation of the motor 44 through one step or increment.

The change in the data transmitted from the register 104 to the digital-to-analog converter 136 changes the voltage transmitted to the voltage-to-frequency converter 140. Therefore, the frequency of the next pulse transmitted to the stepper motor driver 116 is changed.

The foregoing steps are repeated to vary the speed of operation of the motor 44 in accordance with the data stored in the register 104 during the discharge portion of the pump operating cycle. The data stored in the register 104 is calculated so as to vary the rate of operation of the motor 44 to maintain the speed of movement of the pump piston 54 constant during the discharge portion of a pump operating cycle. Therefore, during the discharge portion of the pump operating cycle, a constant flow rate of ink is maintained from the pump assembly 40.

During the discharge portion of the pump operating cycle, the motor 44 is operated through one-half of a revolution. Although the speed of operation of the motor 44 varies, the motor is operated at a relatively low rate so that the speed of movement of the piston 54 is relatively slow. This results in the discharge portion of the pump operating cycle being of a substantially greater duration than the intake portion of the pump operating cycle.

Since the voltage signal conducted over the lead 110 to the digital-to-analog converter 148 varies in magnitude as a function of variations in press operating speed, the speed at which the motor 44 is driven during the discharge portion of the pump operating cycle is varied as a function of press operating speed. However, during the intake portion of the pump operating cycle, a relatively high and constant voltage conducted over the lead 126 from the sensor 112 effects operation of the motor 44 at a relatively high and constant speed to enable the intake portion of the pump operating cycle to be completed as fast is reasonably possible. Therefore, during the intake portion of the pump operating cycle, the speed of operation of the motor 44 is independent of press operating speed.

The main motor control system 100 for controlling the speed of operation of only one of the motors 44 and associated pump assembly 40 is illustrated in FIG. 3. However, a motor control system 100 is provided in association with each of the motors 44 and pump assemblies 40.

A main control assembly 160 is provided in association with the printing press 10. The main control assembly 160 (FIG. 3) can be manually actuated to transmit a stop signal over a lead 162 to interrupt operation of the stepper motor driver 116. In addition, the main press control assembly 160 can be actuated to transmit a signal over a lead 164 to determine whether the motor 44 is driven in a clockwise or counterclockwise direction. In one specific instance, the control assembly 60 was an Intel 80286 Microprocessor. However, other suitable control assemblies could be used if desired.

Although one specific motor control system 100 has been described in conjunction with the motor 44, it should be understood that other known motor control systems could be used if desired. In fact, the ink pump assemblies 40 could have a substantially different construction and b driven directly from the main drive for the printing press. This would result in the elimination of the motor 44 and the motor control system 100.

Auxiliary Apparatus

In accordance with a feature of the present invention, an auxiliary apparatus 200 (FIG. 1) is used in association with the printing press 10 to supply ink to the printing press upon failure of a main pump assembly 40 or 42 to supply ink to the ink rail 36 or 38 and while the failed pump assembly remains at a pumping station in the printing press. During normal operation of the printing press 10, the auxiliary apparatus 200 is kept at a remote location spaced from the printing press. Upon failure of a main pump assembly 40 or 42 to properly supply into to the ink rail 36 or 38, the auxiliary apparatus 200 is moved from the remote location to an operating location adjacent to the failed main pump assembly 40 or 42.

Assuming that the main pump assembly 42 fails to operate, the auxiliary apparatus 200 is moved to an operating location adjacent to the malfunctioning main pump assembly 42, as shown in FIG. 1. An ink supply conduit 202 which normally connects main pump assembly 42 in fluid communication with the ink rail 38, is disconnected from the ink rail 38 in the manner shown schematically in FIG. 1. Once the conduit 202 has been disconnected from the ink rail 38, the failed main pump assembly 42 is no longer connected in fluid communication with ink rail 38. After the failed main pump assembly 42 has been disconnected from the ink rail 38, the auxiliary apparatus 200 is connected with the ink rail 38 to supply ink to the ink rail. The failed main pump assembly (42) remains at a pumping station in the printing press (10) (FIG. 1). Thus, whenever one or more main pump assemblies break down and/or fail to operate correctly, the auxiliary apparatus 200 can be utilized to supply ink to the ink rail in place of the malfunctioning pump assembly or assemblies while the malfunctioning pump assembly or assemblies remains in the printing press (10).

The auxiliary apparatus 200 is normally maintained separate from the printing press 10 at a remote storage location. Thus, the auxiliary apparatus 200 is normally disconnected from the ink rail 38 and from other components of the printing press. Upon a failure of a main pump assembly, such as the main pump assembly 42, the main pump assembly is stopped and disconnected from the ink rail 38. The auxiliary apparatus 200 is then connected with the ink rail 38. Thus, the connector 206 at one end of the conduit 202 normally connects the main pump assembly 42 with the ink rail 38. Upon a failure of the main ink pump assembly 42 to operate correctly, operation of the main pump assembly is interrupted and the connector 206 is then disconnected from the ink rail 38.

Once the failed main pump assembly 42 has been stopped and disconnected from the ink rail 38, the auxiliary apparatus 200 is connected in fluid communication with the ink rail 38 through a conduit 210. Thus, a connector 212 at one end of the conduit 210 is connected with the ink rail 38. The connector 212 has the same construction as the connector 206 so that the conduit 210 can be readily connected with the ink rail 38 in place of the conduit 202. Although the connectors 206 and 212 could have many different constructions, the connectors may be push-in fittings of the type which are commercially available from Legris of Rochester, New York. Of course, many other types of connectors, such as quick disconnect couplings, threaded couplings, etc. could be used if desired.

The auxiliary apparatus 200 includes an auxiliary pump assembly 216. The auxiliary ink pump assembly 216 is connected with a drive motor 218. A motor control systems 222 is connected with the auxiliary motor 218 to control the speed of operation of the motor.

It should be understood that the auxiliary apparatus 200 includes a plurality of auxiliary pump assemblies 216, motors 218, drive assemblies 220 and control systems 222. Although only a pair of auxiliary pump assemblies 216, motors 218, drive assemblies 220 and control systems 222 have been shown in FIG. 1, any desired number could be provided in the auxiliary apparatus 200. It is contemplated that the number of auxiliary pump assemblies 216, motors 218, drive assemblies 220 and control systems 222 in the auxiliary apparatus 200 may be equal to the number of main pump assemblies 42 used to supply the rail 38 with ink. However, if only one of the main pump assemblies 42 fails to operate satisfactorily, only one of the auxiliary pump assemblies 216 would have to be connected with the ink rail 38. Of course, if a plurality of main pump assemblies 42 fail to operate satisfactorily, a corresponding number of the auxiliary pump assemblies 216 would be connected with the ink rail 38.

The auxiliary pump assemblies 216, motors 218, drive assemblies 220 and motor control systems 222 have the same construction and mode of operation as the main pump assembly 40, motor 44, drive assembly 52 and motor control system 100 previously described herein. Thus, the auxiliary pump assembly 216 includes a piston which is reciprocated by operation of the drive assembly 220. The drive assembly 220 is driven by the motor 218 which is of the well known stepper type. The motor control system 222 varies the rate of operation of the motor 218 to drive the auxiliary pump assembly 216 through an operating cycle which includes an intake portion of relatively short duration and a discharge portion of relatively long duration. In addition, motor control system 222 varies the rate of operation of the pump drive motor 218 during the discharge portion of the operating cycle to maintain a constant rate of flow of ink from the auxiliary pump assembly 216.

Although the auxiliary pump assembly 216 is operated to discharge ink at a constant rate during the discharge portion of the pump operating cycle, the rate of operation of the motor 218 during the discharge portion of the pump operating cycle is varied with variations in press speed. This is because the demand for ink varies with variations in press speed. However, during the short duration intake portion of the pump operating cycle, the drive motor 218 is always operated at the same relatively high rate. This is done in order to minimize the duration of the intake portion of the operating cycle of the auxiliary pump assembly 216 at all operating speeds of the printing press 10.

The auxiliary motor control system 222 varies the speed of operation of the auxiliary motor 218 during the discharge stroke of the auxiliary pump assembly 216 as a function of variations in the operating speed of the printing press 10 and as a function of variations in the density with which ink is applied to the sheet material 16. Thus, the speed of operation of the motor 218 varies as a direct function of variations in the operating speed of the printing press 10. The greater the operating speed of the printing press 10, the greater is the demand for ink and the greater is the speed at which the motor control system 222 effects operation of the auxiliary motor 218 and auxiliary pump 216.

The speed of operation of the auxiliary motor 218 also varies as a direct function of variations in the ratio of the area of the sheet material 16 which is to be covered by ink to the total area of the sheet material. The greater the area of the sheet material which is to be covered by ink, the greater is the speed of operation of the auxiliary motor 218. Thus, the greater the density of the ink on the sheet material, the greater the speed of operation of the motor 218 to drive the auxiliary pump assembly 216 to supply the necessary quantity of ink.

The auxiliary apparatus 200 includes an auxiliary reservoir 226 for holding a supply of ink. Ink is conducted from the reservoir 226 to the auxiliary pump assembly 216 through an inlet conduit 228. Although it may be preferred to provide a separate reservoir 226 of ink to supply the auxiliary pump assembly 216, it is contemplated that the auxiliary pump assembly 216 could be connected with the source of ink from the main pump assembly 42. If this is to be done, a conduit would be provided to connect the auxiliary pump assembly 216 with the main ink supply reservoir for the printing press 10. The auxiliary pump assembly 216 may be connected with the main ink supply reservoir by disconnecting the supply conduit for a failed main pump assembly 42 from the main ink supply reservoir and connecting the supply conduit for the auxiliary pump assembly 216 with the main ink supply reservoir at the same connection.

The motor control system 222 for the auxiliary pump assembly 216 is connected with controls 232 for the printing press 10 through an auxiliary apparatus controller 234. The controls 232 for the printing press 10 provide the controller 234 with input signals corresponding to the speed of operation of the printing press 10 and the desired density of ink on the sheet material 16. The controller 234 could be mounted on a movable base or cart 238 along with the auxiliary pump assembly 216 and reservoir 226 if desired. However, it is contemplated that it may be desired to mount the controller 234 on a separate movable base or cart so that the auxiliary pump assembly 216 can be moved to a location adjacent to a failed main pump assembly 42 while the controller 234 remains in an aisle separated by some distance from the auxiliary pump assembly 216.

During operation of the auxiliary pump assembly 216 to supply ink to the ink rail 38, the auxiliary motor control system 222 effects operation of the auxiliary motor 218 to drive the auxiliary pump assembly in the same manner as in which the motor control system 100 effects operation of the main pump assembly 42. Therefore, ink is supplied by the auxiliary apparatus 200 to the ink rail 38 in the same manner as in which it was supplied by the main pump assembly 42 before the main pump assembly malfunctioned.

Figure 4:
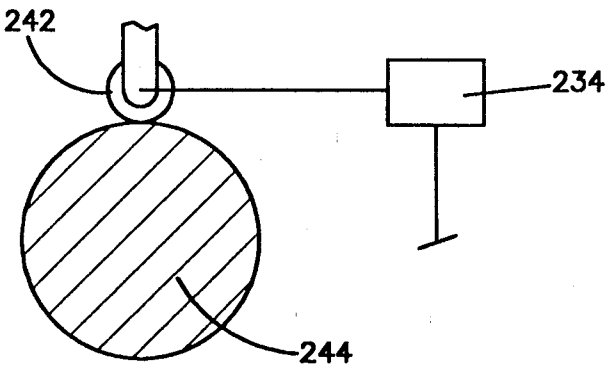
FIG. 4 is a schematic illustration depicting the manner in which a tachometer engages the drive shaft in the printing press of FIG. 1 to transmit a signal to the auxiliary apparatus.

Although it is preferred to connect the controller 234 for the motor control system 222 with the main controls 232 for the printing press 10, it is contemplated that for some printing presses it will be necessary to have the controller 234 function separately from the main controls for the press. If this is to be done, a tachometer pickup assembly 242 (FIG. 4) is temporarily mounted in engagement with a shaft 244 of the printing press. The shaft 244 is driven by the main press drive at a speed which varies as a function of variations in the speed of operation of the printing press. Therefore, an output signal transmitted from the tachometer pickup assembly 242 to the controller 234 will vary as a direct function of variations in the operating speed of the printing press.

When the controller 234 functions separately from the main controls for a printing press, the controller is supplied with a separate input, either manually or by an electrical signal, which is indicative of the ink density on the sheet material 16. Of course, other methods of controlling the speed of operation of the auxiliary apparatus 200 as a function of printing press speed and density of ink on the sheet material 16 could be utilized if desired.

Although it is preferred to have the auxiliary pump assembly 216 have the same construction as the main pump assembly 42, other known types of pump assemblies could be utilized if desired. It should also be understood that although it is preferred to drive the auxiliary pump assembly 216 with the motor 218 through a drive assembly 220 having the same construction as the drive assembly 52, the drive assembly 220 could have a different construction if desired. In addition, it should be understood that although it is preferred to utilize a motor control system 222 having the same construction as the motor control system 100, a motor control system having a different construction could be utilized if desired.

CONCLUSION

The present invention provides a new and improved auxiliary apparatus 200 and method for supplying ink to a printing press 10 upon failure of a main ink pump 42. The auxiliary apparatus 200 includes a portable auxiliary ink pump 216 which is maintained separate from the printing press 10 during normal operation of the main ink pump 42. Upon failure of the main ink pump 42 to supply ink to the printing press 10, the auxiliary ink pump 216 is moved from a remote location spaced from the printing press to an operating location (FIG. 1) adjacent to the failed main ink pump 42. A conduit 210 is provided to connect auxiliary ink pump 216 in fluid communication with the printing press 10. A motor 218 connected with the auxiliary ink pump 216 is then operated to drive the auxiliary ink pump to supply ink to the printing press 10 through the conduit 210.

Having described the invention, the following is claimed:

1. An apparatus for use in supplying ink to a printing press upon failure of a main ink pump at a pumping station in the printing press to supply ink to an applicator which applies ink to a roll of the printing press, said apparatus comprising portable auxiliary ink pump means which is maintained separate from the printing press during operation of the main ink pump at the pumping station in the printing press, motor means spaced from the printing press and connected with said auxiliary ink pump means for driving said auxiliary ink pump means while said auxiliary ink pump means and motor means are spaced from the printing press to supply ink upon failure of the main ink pump to supply ink and while the failed main ink pump is at the pumping station in the printing press, conduit means connected in fluid communication with said auxiliary ink pump means for conducting a flow of ink from said auxiliary ink pump means to the printing press during operation of said motor means with the failed main ink pump at the pumping station in the printing press and with said auxiliary ink pump means and motor means spaced from the printing press, and connector means for connecting said conduit means in fluid communication with the applicator upon failure of the main ink pump to supply ink, said connector means being effective to connect said conduit means with the applicator while the failed main ink pump is at the pumping station in the printing press and while said auxiliary ink pump means and motor means are spaced from the printing press.

2. An apparatus as set forth in claim 1 further including motor control means for effecting operation of said motor means to drive said auxiliary ink pump means at a speed which varies as a function of variations in the operating speed of the printing press during operation of said motor means to drive said auxiliary ink pump means while the failed main ink pump means is at the pumping station in the printing press and while said auxiliary pump means and motor means are spaced from the printing press.

3. An apparatus as set forth in claim 1 further including ink density control means connected with said motor means for enabling the speed of operation of said motor means to be varied as a function of variations in the ratio of the area of the material which is to be covered by ink to the total area of the sheet material while the failed main ink pump means is at the pumping station in the printing press and while said auxiliary pump means and motor means are spaced from the printing press.

4. A method comprising the steps of operating a main ink pump disposed at a pumping station in a printing press to supply ink of a first color to an applicator during operation of the printing press to print on sheet material, moving an auxiliary ink pump from a remote location to a location which is adjacent to the main ink pump and which is spaced from the printing press upon failure of the main ink pump to properly supply ink to the applicator, interrupting operation of the main ink pump, connecting the auxiliary ink pump in fluid communication with the applicator while the failed main ink pump is at the pumping station in the printing press and while the auxiliary ink pump is spaced from the printing press, said step of connecting the auxiliary ink pump in fluid communication with the applicator being performed after having performed said step of moving the auxiliary ink pump from the remote location to the location adjacent to the main ink pump, and operating the auxiliary ink pump to supply ink of the first color to the applicator with the auxiliary ink pump spaced from the printing press, said step of operating the auxiliary ink pump to supply ink of the first color to the applicator being at least partially performed with the failed main ink pump at the pumping station in the printing press and after having performed said step of interrupting operation of the failed main ink pump.

5. A method as set forth in claim 4 wherein said step of moving the auxiliary ink pump to a location adjacent to the main ink pump includes moving an auxiliary motor to the location adjacent to the main ink pump with the auxiliary motor connected to the auxiliary ink pump, said step of operating the auxiliary ink pump includes driving the auxiliary ink pump with the auxiliary motor to pump ink of the first color while the auxiliary ink pump and auxiliary motor are spaced from the printing press, said step of driving the auxiliary ink pump with the auxiliary motor bearing at least partially performed with failed main ink pump at the pumping station in the printing press.

6. A method as set forth in claim 4 further including the step of disconnecting the main ink pump from said applicator prior to performing said step of operating said auxiliary ink pump to supply ink to the applicator.

7. A method as set forth in claim 4 wherein said step of operating the main ink pump to supply ink to the applicator includes pumping ink from a main source of ink to the applicator with the main ink pump at the pumping station in the printing press, said step of operating the auxiliary ink pump to supply ink to the applicator includes pumping ink from the main source of ink to the applicator with the auxiliary ink pump and while the auxiliary ink pump is spaced from the pumping station in the printing press, said step of pumping ink from the main source of ink by operating the auxiliary ink pump being at least partially performed with failed main ink pump at the pumping station in the printing press.

8. A method as set forth in claim 4 wherein said step of moving the auxiliary ink pump to the location adjacent to the main ink pump includes moving an auxiliary source of ink to the location adjacent to the main ink pump, said step of operating the auxiliary ink pump to supply ink to the applicator includes pumping ink from the auxiliary source of ink to the applicator with the auxiliary ink pump and auxiliary source of ink spaced form the pumping station in the printing press, said step of pumping ink from the auxiliary source of ink by operating the auxiliary ink pump being at least partially performed with the failed ink pump at the pumping station in the printing press.

9. A method as set forth in claim 4 wherein said step of operating the auxiliary ink pump to supply ink to the applicator includes varying the speed of operation of the auxiliary ink pump as a function of variations in the speed of operation of the printing press while the auxiliary ink pump is spaced from the printing press, said step of varying the speed of operation of the auxiliary ink pump as a function of variations in the speed of operation of the printing press being at least partially performed with the failed ink pump at the pumping station in the printing press.

10. A method comprising the steps of operating a main ink pump disposed at a pumping station in a printing press to supply ink of a first color to an applicator during operation of the printing press to printing on sheet material, said step of operating a main ink pump to supply ink to the applicator includes the step of varying the speed of operation of the main ink pump as a function of variations in the speed of operation of the printing press, moving an auxiliary ink pump and an auxiliary motor from a remote location spaced a first distance from the printing press to a second location which is spaced a second distance from the printing press upon failure of the main ink pump to properly supply ink to the applicator, said second distance being less than said first distance, connecting the auxiliary ink pump in fluid communication with the applicator while the failed main ink pump is at the pumping station in the printing press and while the auxiliary ink pump is spaced from the printing press, driving the auxiliary ink pump with the auxiliary motor while the auxiliary ink pump and auxiliary motor are spaced from the printing press to supply ink of the first color to the applicator, said step of driving the auxiliary ink pump with the auxiliary motor being at least partially performed with the failed main ink pump at the pumping station in the printing press, said step of driving the auxiliary ink pump with the auxiliary motor includes the step of varying the speed of operation of the auxiliary motor as a function of variations in the speed of operation of the printing press while the auxiliary motor is spaced from the printing press.

* * * * *

UNITED STATES PATENT AND TRADEMARK OFFICE

CERTIFICATE OF CORRECTION

PATENT NO. : 5,168,807

DATED : December 8, 1992

INVENTOR(S) : Frederick J. Elia and Giacinto R. Mazzenga

It is certified that error appears in the above-identified patent and that said Letters Patent is hereby corrected as shown below:

Column 17, line 31, change "form" to -- from --.

Signed and Sealed this

Eleventh Day of January, 1994

*Attest:*

*Attesting Officer*

BRUCE LEHMAN

*Commissioner of Patents and Trademarks*